US007445829B2

(12) United States Patent
Whaley

(10) Patent No.: US 7,445,829 B2
(45) Date of Patent: Nov. 4, 2008

(54) WASHER, METHODS, APPARATUS AND UPHOLSTERY

(75) Inventor: Jonathon Nicholas Whaley, Mursley (GB)

(73) Assignee: Jonathan Nicholas Whaley, Mursley, Buckinhamshire (GB)

( * ) Notice: Subject to any disclaimer, the term of this patent is extended or adjusted under 35 U.S.C. 154(b) by 206 days.

(21) Appl. No.: 10/560,024

(22) PCT Filed: Jun. 9, 2004

(86) PCT No.: PCT/GB2004/002441

§ 371 (c)(1),
(2), (4) Date: Apr. 25, 2006

(87) PCT Pub. No.: WO2004/107926

PCT Pub. Date: Dec. 16, 2004

(65) Prior Publication Data

US 2006/0240215 A1 Oct. 26, 2006

(30) Foreign Application Priority Data

Jun. 9, 2003 (GB) ..... 0313232.1

(51) Int. Cl.
*B68G 7/08* (2006.01)

(52) U.S. Cl. ..... 428/66.6; 24/114.3; 24/114.1; 24/102 T

(58) Field of Classification Search ..... 428/66.6; 24/102 T, 114.3, 114.1, 114, 114.4, 114.7
See application file for complete search history.

(56) References Cited

U.S. PATENT DOCUMENTS 1,887,066 A * 11/1932 Patchen ..... 24/102 R
6,032,345 A * 3/2000 Resta ..... 29/91.4

FOREIGN PATENT DOCUMENTS

GB 538157 7/1941
GB 1121230 7/1968

* cited by examiner

*Primary Examiner*—Alexander Thomas
(74) *Attorney, Agent, or Firm*—Senniger Powers LLP

(57) ABSTRACT

A washer (100) comprising wadding material and having an aperture (104) extending therethrough is disclosed. The wadding material is compressed at least around the periphery (102) of the aperture (104). The compressed wadding material is sufficiently elastic such that, when fitted to upholstery together with a tuft, the dimensions of the aperture may increase sufficiently to accommodate a tufting needle and then return to its original dimensions after withdrawal of the needle so as to, prevent disengagement of the tuft.

10 Claims, 5 Drawing Sheets

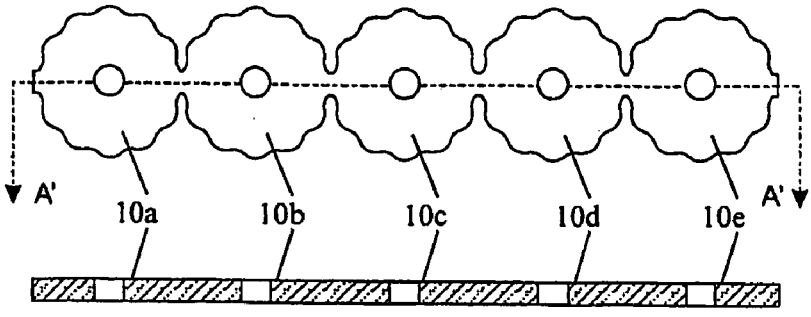
Fig. 4a
Fig. 4b
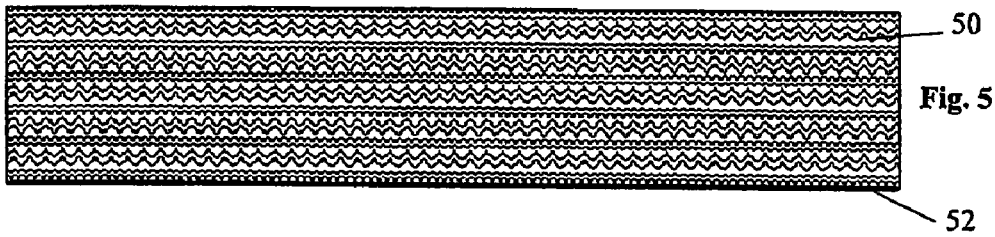
Fig. 5
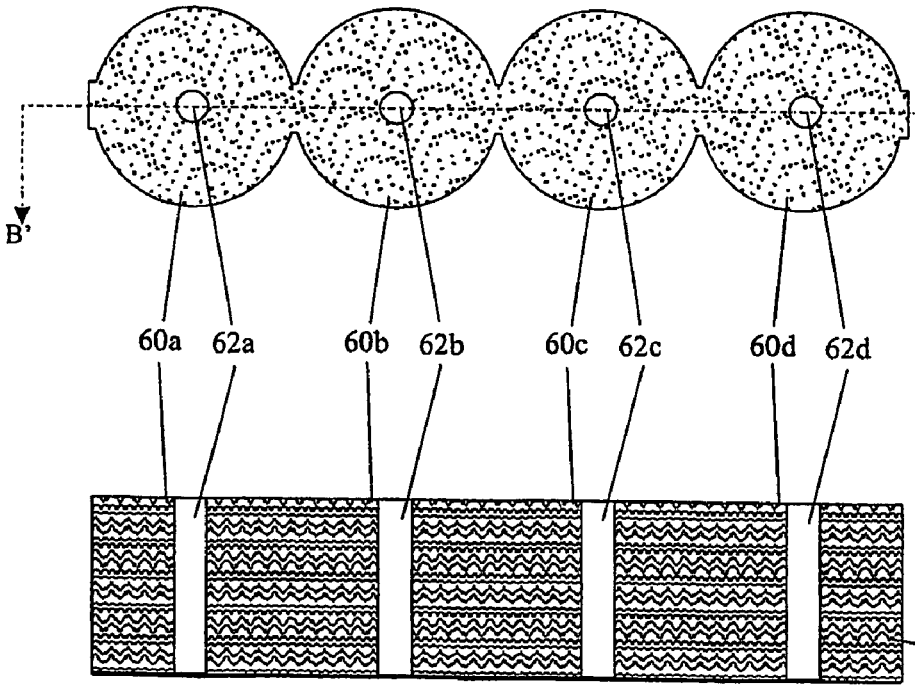
Fig. 6a
Fig. 6b

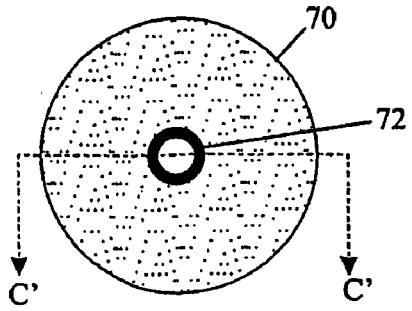
Fig. 7a
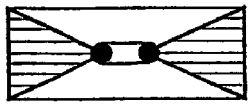
Fig. 7b
Prior Art
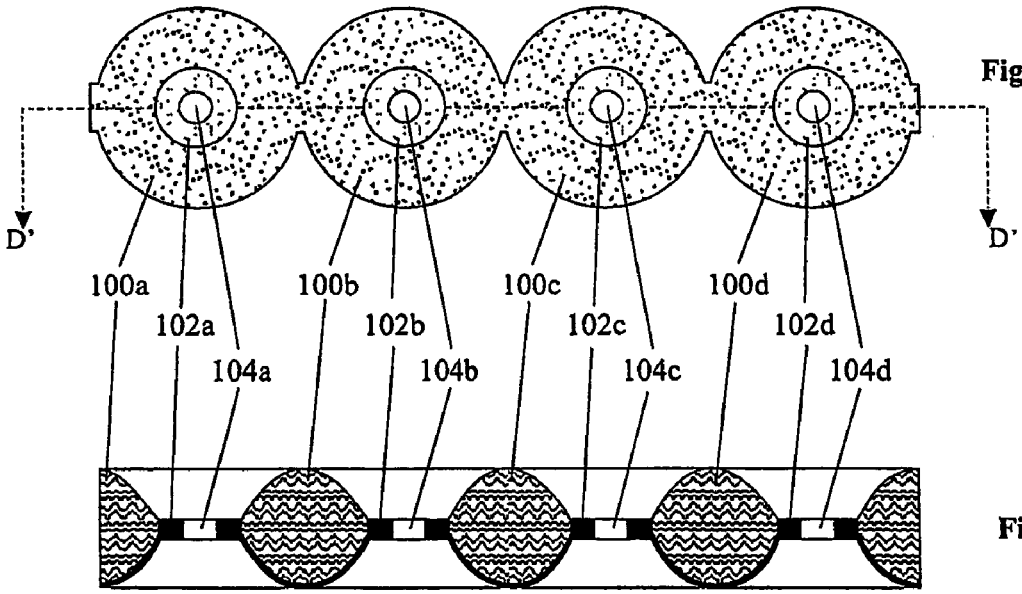
Fig. 8a
Fig. 8b
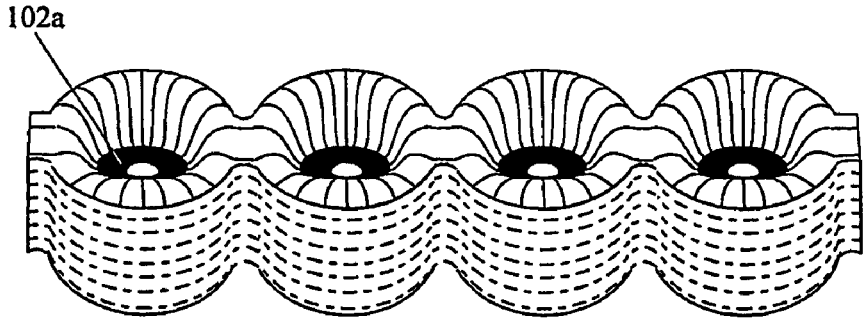
Fig. 9

WASHER, METHODS, APPARATUS AND UPHOLSTERY

This invention relates to a washer, particularly but not exclusively a washer suitable for use in the automatic tufting of upholstery. The invention also relates to a method of manufacturing the washer, a method and apparatus for automatically tufting upholstery using the washer, and upholstery fitted with the washer and/or tufted according to the apparatus and method.

Upholstery, in particular mattresses, has long been held together by means of tufts. The tuft serves to stabilise the outer layers of materials, tickings and fillings of the mattress.

The invention will be described hereinafter with reference to the tufting of mattresses. However, the skilled reader will understand that the tufts described in the present invention are suitable for the tufting of all types of upholstery, for example cushions and pillows, and cushion or mattress elements of more complex upholstery units such as chairs, sofas, futons and the like.

In the art, the word 'tuft' is generally taken to comprise two elements (hereinafter known as 'tuft elements') located so that each one is outside each principal face of the mattress, the tuft elements being held together by means of a cord, loop or the like (hereinafter known as a 'retaining link') attached to each tuft element. In this specification, the word 'tuft' when used alone refers to the complete arrangement of tuft element, retaining link and further features.

One type of tuft known in the art is the 'tape tuft'. Tape tufts typically comprise a flexible strip (usually made of cotton, polyester, nylon, polypropylene or a combination of any of these or similar materials) adapted to pass through the mattress, which interacts at either end with a tuft element, typically a retainer bar (which may be made of metal or plastic) so that, in use, the bar is present on the outside of the mattress. Tape tufts are described and illustrated in GB 814651, and are also known in the trade as POPIN® tufts or 'long/long tapes'.

Tape tufts have historically been attached to the mattress using a needle, such as a tufting or ejector needle, the structure of which is well known to those skilled in the art. An example of a tufting needle is given in GB 903464, the contents of which are incorporated herein by reference thereto.

The mattress is first compressed to a thickness less than the length of the tape tuft to be used. One of the tuft elements is inserted into a recess in the tufting needle, leaving the other end free. The tufting needle, carrying the first tuft element, is then passed through both faces of the mattress, the second (free) tuft element being unable to pass through the hole made by the needle and consequently remaining outside the mattress. When the tufting needle exits the mattress, the first tuft element is released so that both tuft elements are located on the outside faces of the mattress. The tufting needle may further be provided with elastic means, such as a spring-loaded plunger, which ejects or otherwise aids release of the first tuft element from the tufting needle. Once the tufting process is complete, the mattress is decompressed.

Many manufacturers use a support, such as a washer, in connection with the tape tuft; a support may be provided on either or both faces of the mattress. The function of such supports is to prevent the tuft element from being pulled through the mattress ticking and to make the tuft more comfortable to sit or lie on.

FIGS. 1*a* & 1*b* show the traditional washer 10 made of felt, leather, plastic or other soft but suitably stable material. Typically, washers used in the tufting of upholstery are of diameter 30-50 mm and a 3-6 mm thickness. The aperture 12 must be of a nature to allow a tufting needle or the like to pass though; typically the aperture is about 3-4 mm in diameter but because the type of material in normal use is felt, or similar pliable material, the needle which may be of 5-7 mm in diameter may temporarily stretch the material in order to pass through.

When a mattress is tufted according to prior art methods, a first washer may be fitted to the proximal face of the mattress (i.e. the face the needle enters) by attaching it to the free tuft element, the washer being unable to pass through the mattress. When the needle emerges from the distal face of the mattress, its point may engage a second washer so that when the first tuft element is released from the tufting needle, the washer need only be disengaged from the needle point to be in the correct position. Alternatively, the second washer may be placed on the tuft element after it has been ejected from the tufting needle, before the mattress is decompressed.

FIG. 2 shows a section of a mattress 20 with two conventional washers 10*a* and 10*b* together with a tape tuft 12.

The tufting method described hereinabove has traditionally been carried out manually. The operator may have to apply a considerable amount of force to drive the tufting needle through the mattress. This makes the process slow and inefficient, and repeatedly applying such forces over a long period of time may be detrimental to the health of the operator.

In order to increase automation of the tufting process, to make it faster and more efficient, and less reliant on manual effort, the present applicant has developed the automatic tufting device and method described and illustrated in GB-A-2363803. This is particularly advantageous when used to fit tape tufts connected in series in a string as described and illustrated in GB-A-2371479. The entire disclosure of these specifications is incorporated herein by reference thereto.

Although tape tufts are commonly used in the art and can rapidly and efficiently be fitted to a mattress using the device and method described and illustrated in GB-A-2363803, mattresses tufted using such tufts are generally less comfortable to sit or lie on due to the rigidity of the tuft elements. Moreover, the customer generally considers such tuft elements detrimental to the aesthetics of the mattress.

Another type of tuft element well known in the art is the rosette tuft element, illustrated in FIGS. 3*a* and 3*b*.

The rosette tuft element 30 may, for example, be made by winding yarn around two spindles, securing the windings together in the middle (illustrated by reference number 32) while they remain wound around the two spindles, and withdrawing the spindles. The windings may be secured together by, for example, tying, clasping or stapling. The resulting tuft element has a substantially circular or oval shape (the overall impression being similar to a rosette). The yarn may be woollen yarn, synthetic yam (such as rayon or nylon) resembling wool, or a combination of the two, optionally including other yarn string-like or ribbon-like material. Such rosette tuft elements are often preferred by the customer due to their perceived aesthetic quality, and as a mattress tufted using such elements is generally more comfortable to sit or lie on than a mattress tufted with tape tufts.

Rosette tuft elements equipped with attachment means to allow them to be fitted more conveniently to a mattress are described and illustrated in GB-A-2349332, GB-A-2381744 and pending GB application no. 0214443.4. However, as rosettes are held together at the centre by their windings, it is not possible to fit them to a mattress using an automatic tufting device and method such as that described and illustrated in GB-A-2363803 without destroying the construction of the rosette.

As washers contain an aperture extending through the centre thereof, a tufting needle may conveniently pass through the aperture. It is therefore possible to fit washers to a mattress using an automatic tufting device and method such as that described and illustrated in GB-A-2363803. A suitable means for engaging and placing washers in their correct position may take the form of feed means arranged for cooperation with the automatic tufting device.

A preferred method of fitting washers is described in GB patent application no. 0302824.8. This application discloses washers 10*a*, 10*b*, 10*c*, 10*d*, 10*e* linked in a continuous chain (as illustrated in FIGS. 4*a* and 4*b* of the present application) and that a single washer be cut from the chain prior to the needle and a tuft head passing through the central hole of the washers.

For reasons of comfort and aesthetics, it is desirable to form washers from materials such as pure unspun wool or pure cotton or any other suitable soft material which has tactile properties similar to unspun wool or cotton wool, made up of layers or as a single thick layer. In the present specification such materials are referred to as 'wadding material'. Such a material is highly compressible. Preferably the wadding material takes the tactile form of cotton wool.

FIG. 5 shows a strip of wadding material 50 having a membrane 52 fixed either by adhesive, heat or needle action, to the wadding. The thickness of the combined wadding material and membrane may typically be 10-25 mm. This membrane is made of a very thin material with very limited elastic properties. The membrane may be of a fusible material such as polyester. The purpose of the membrane 52 is to provide transport support so that, during the manufacturing process and subsequent handling in an automatic tufting machine, the wadding is not subject to any tension. This membrane may be omitted should the wadding posses sufficient lateral stability and acceptable limited elasticity.

FIGS. 6*a* and 6*b* show a section of washers 60*a*, 60*b*, 60*c*, 60*d* cut in a chain from the wadding. As can be seen, the apertures 62*a*, 62*b*, 62*c*, 62*d* which allow a tufting needle to pass through during fitting are long and thin in comparison to the thickness of the wadding material. As wadding material, unlike the stable felt, plastic and leather materials used to form washers in the prior art, is essentially unstable material in that the layers of the wadding are somewhat free to move relative each other and after winding on to a reel for convenient feeding to an automatic tufting machine and the subsequent handling of the sheet of wadding material, it is unlikely that the top and bottom of the apertures will remain aligned, despite the presence of the membrane 52.

Whilst it might, in theory, be possible to have the strip of wadding material 50 simply fed into the automatic tufting machine, the machine would have to cut the washer shape out of the strip. This is inefficient as it would slow down the tufting process and require the machine to handle the waste material.

It could, theoretically, also be possible to pierce the washers illustrated in FIGS. 6*a* and 6*b* with a tufting needle without having a hole pre-pierced. However, this confers significant disadvantages if the needle was not kept fully sharp, as there would be a tendency for the needle to try and push the washer into the mattress ticking as well as dragging fibres out of the washer as the needle and tape tuft passed through it.

An alternative prior art washer 70 is shown in FIGS. 7*a* and 7*b*. This washer can also be made up of layers of soft material similar to wadding material. When fitted to a mattress together with a tape tuft in tension, the washer folds, partially shielding the tape tuft element from view and covering the hard tape tuft element with a softer, more tactile element. However, this prior art washer uses a metal eyelet 72 to hold the wadding together. This confers significant disadvantages, as it essentially fixes the size of the aperture. If the eyelet and area around the eyelet are too small, the resulting aperture is too small for a tufting needle of an automatic tufting device to work with. An eyelet big enough to allow a tape tufting needle through would be too big, risking the possibility of the head of the tape tuft passing back through the eyelet.

It is therefore an objective of the present invention to provide a washer made of sufficiently soft material such that it exhibits the perceived high quality appearance and comfort properties of known soft tuft elements such as the rosette tuft, while being suitable for fitting to upholstery using an automatic tufting machine and avoiding the disadvantages associated with the fixed size of the aperture of the prior art washers fitted with eyelets.

In a first aspect, the invention provides a washer comprising wadding material and having an aperture extending therethrough, characterised in that the wadding material is permanently compressed around the periphery of the aperture whilst maintaining sufficient elasticity of the compressed wadding material such that, when fitted to upholstery together with a tuft, the dimensions of the aperture may increase sufficiently to accommodate engagement means for the tuft and then return to a resting state after disengagement of the engagement means for the tuft so as to prevent disengagement of the tuft.

In a second aspect, the invention provides a method of manufacturing a washer from wadding material, the method comprising, in any order, the following steps (a) to (c):

(a) permanently compressing the wadding material at least in a region intended to form the aperture of the washer and its periphery;

(b) forming an aperture extending through the compressed region of the material, the material being compressed around the periphery of the aperture; and (c) separating the washer from the wadding material;

so that the compressed wadding material of the washer exhibits sufficient elasticity at least around the periphery of the aperture such that, when the washer is fitted to upholstery together with a tuft, the dimensions of the aperture may increase sufficiently to accommodate engagement means for the tuft and then return to a resting state after disengagement of the engagement means for the tuft so as to prevent disengagement of the tuft.

In further aspects, the invention provides a method and apparatus for automatically tufting upholstery using the washer according to the invention, and upholstery produced by such method and apparatus.

FIG. 1*a* is a plan view of a washer traditionally used in the tufting of mattresses;

FIG. 1*b* is a side view of the washer of FIG. 1*a;*

FIG. 2 is a sectional view of a mattress fitted with two conventional washers and a tape tuft;

FIG. 3*a* is a plan view of a rosette tuft element;

FIG. 3*b* is a side view of a rosette tuft element;

FIG. 4*a* is a top view of conventional washers linked in a continuous chain (as described and illustrated in GB patent application no. 0302824.8);

FIG. 4*b* is a section taken along the line A'-A' of FIG. 4*a;*

FIG. 5 is a side view of known wadding material suitable for use in the washers according to the invention;

FIG. 6*a* is a top view of a chain of washers cut in a chain from the wadding of FIG. 5;

FIG. 6*b* is a section taken along the line B'-B' of FIG. 6*a;*

FIG. 7*a* is a top view of an alternative known prior art washer;

FIG. 7*b* is a section taken along the line C'-C' of FIG. 7*a;*

FIG. 8*a* is a top view of a chain of washers produced according to the invention;

FIG. 8*b* is a section taken along the line D'-D' of FIG. 8*a;*

FIG. 9 shows a perspective view of the washers produced according to the invention;

FIG. 10*a* illustrates apparatus for manufacturing the washers according to the invention;

FIG. 10*b* is a section taken along the line E'-E' of FIG. 10*a;*

FIG. 10*c* is a section taken along the line F'-F' of FIG. 10*b;*

Figure 1A:
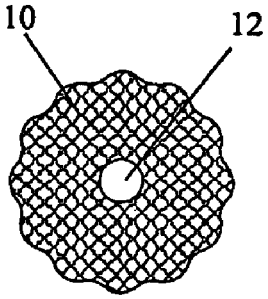
Figure 1B:
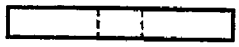
Fig 1b Prior Art
Figure 2:
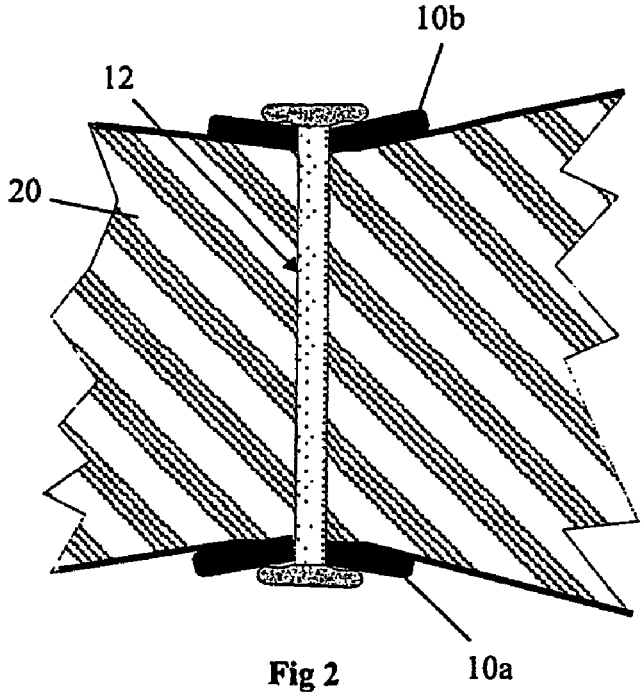
Fig 2 Prior Art
Figure 3A:
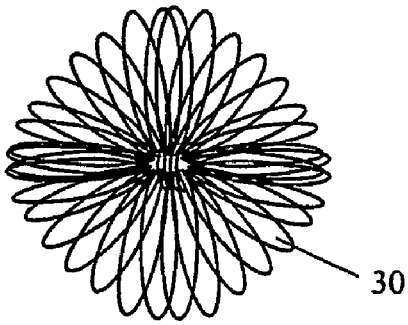
Figure 3B:
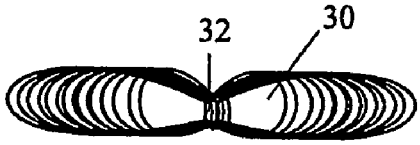

The present invention relates to a washer. In the context of this specification the word 'washer' refers in general terms to a roughly disc-shaped member having one or more (but preferably only one) apertures extending through the washer between the top and bottom faces thereof (i.e. through the smallest dimension of the washer), as exemplified by the general shape of washers of FIGS. 1 and 7. The precise shape of the washer is not critical provided that, in the finished washer, the dimensions of the aperture are of sufficient size and elasticity such that, when fitted to upholstery together with a tuft, the dimensions of the aperture may increase sufficiently to accommodate engagement means for the tuft (particularly a tufting needle of an automatic tufting machine) and then return to a resting state (i.e. substantially the same as the original size of the aperture after formation) after disengagement of the engagement means for the tuft so as to prevent disengagement of the tuft. As will be evident from what is set out below, the final shape of the washer according to the invention may differ somewhat from the standard flat disc of the FIG. 1 washer.

The washer may take any suitable shape when viewed from above, for example, circular, polygonal or an irregular shape, but is preferably roughly circular when viewed from above. It should be understood that, due to the unstable nature of the wadding material, the exact shape will rarely be either identical or perfectly regular but will vary from washer to washer.

The washer of the present invention is made from wadding material. As described above, such materials may comprise pure unspun wool or pure cotton or any other suitable soft material having tactile properties similar to unspun wool or cotton wool. The wadding material may comprise natural or man made fibres or a mixture thereof provided that it has tactile properties similar to unspun wool or cotton wool. Whether or not a material has such properties may be readily ascertained by a person skilled in the art. The material may be made up of layers or comprise a single thick layer. Preferably the wadding material takes the tactile form of cotton wool.

The washer of the present invention has one or more (but preferably only one) aperture extending through the washer between the top and bottom faces thereof. Significantly, in contrast to the prior art washers illustrated in FIGS. 6*a* and 6*b*, the top and bottom of the apertures of the washers produced according to the invention exhibit greatly improved alignment, in spite of the fact that the washers are made from unstable material. This makes the washers of the present invention much more suitable for use in an automatic tufting machine than those of the prior art.

In the method of manufacture of the washer of the present invention, the aperture may be formed by any suitable means known in the art, non-limiting examples of which include cutting (especially die-cutting), punching and piercing with a needle or the like. Punching or die-cutting is preferred. In a particularly preferred embodiment, one or more cuts are made in the washer without actually removing material, which allows the tufting needle to penetrate the washer freely. Most conveniently, 2 cuts are made in the form of a cross.

In the washers according to the present invention, the wadding material itself is compressed around the periphery of the aperture to produce a more solid and stable material, at least around the periphery of the aperture. The compression of the wadding material itself (as opposed to the introduction of an auxiliary such as an eyelet) in the periphery of the aperture (i.e. the area immediately encircling the aperture) is an important feature of the present invention in that compression produces an aperture of sufficient size and elasticity such that, when the washer is fitted to upholstery together with a tuft, the dimensions of the aperture may increase sufficiently to accommodate engagement means for the tuft (particularly a tufting needle of an automatic tufting machine) and then return to a resting state after disengagement of the engagement means for the tuft so as to prevent disengagement of the tuft. It also obviates the need for the use of an eyelet and the disadvantages caused by the eyelet fixing the size of the aperture.

The periphery of the aperture is the area of the wadding material surrounding the aperture. However, as will be set out below, this area may optionally exclude a narrow (typically 1 mm) area immediately surrounding the aperture, which may optionally be left unmodified.

The wadding material of the washer may be compressed in any manner which allows the material to exhibit the necessary elastic properties around the periphery of the aperture. This may be achieved by the application of a pressing tool around the periphery of the intended aperture. Compression of the wadding material around the periphery of the aperture enables the top and bottom of the aperture to remain aligned and allow the apertures to be used to index a chain of washers in an automatic tufting machine.

Compression of the wadding material may take place only in the region intended to form the aperture and its periphery. Alternatively, in order to form the washers of the present invention, the entire strip of wadding material may be compressed and two concentric (preferably circular) areas may be secured on the compressed material in this region (the inner area intended to form the aperture and the outer area its periphery). This securing may be done by any means known in the art, for example by stitching. An aperture can then be formed through the inner secured area and the wadding material can then be decompressed.

In a preferred embodiment, the wadding material is mixed with a further fibrous material, which may be made viscous on the application of heat, ultrasound or any other appropriate means and which then returns to its natural form when the heat or pressure is removed. This material is referred to in this specification as a 'fusible' material. Preferred examples of materials suitable as the fusible material include synthetic fibres such as polyester or polyamide. In this embodiment, the application of heat and/or pressure (preferably both) in the region of the mixed wadding and fusible material for forming the aperture causes the unstable material to melt and/or compress (preferably both) in this region. This allows an aperture to be made in the compressed material cleanly, with minimum waste, and with the top and bottom of the aperture clearly aligned. Ultrasound is a particularly convenient way of achieving the required heating.

In the preferred method of manufacture described above, the compression of the mixed wadding and fusible material around the periphery of the intended aperture may take place before, after, or at the same time as the fusion of the mixed material. However, fusion of the material should take place before formation of the aperture is complete, in order to ensure good alignment of the top and bottom of the formed aperture.

Apparatus for the application of heat and/or pressure (preferably both) to cause melting and/or compression of the mixed wadding and fusible material may be readily envisaged by the person skilled in the art. Without wishing to be bound by theory, it is believed to particularly advantageous if the same tool used to melt and/or compress the mixed wadding and fusible material also forms the aperture in the material more or less simultaneously. A heated pressure rod may be mentioned as a non-limiting example of such a tool.

The wadding material may be mixed with fusible material only in the region enclosing the area intended to be removed to form the aperture and the periphery thereof. However, it is generally more convenient and cost-effective if the material from which the washers of the present invention is to be formed is mixed with fusible material throughout.

In a preferred embodiment, an area immediately surrounding the aperture is uncompressed. In this embodiment, a ring of uncompressed material (typically between 0.2 mm and 4 mm, more preferably between 0.5 mm and 2 mm, in width) is present between the edge of the aperture and the modified region. When the modification is carried out by melting and/or compressing the material (as described above), the ring of material around the edge of the aperture may be left unfused by providing the heating and/or pressing tool with a sleeve suitably dimensioned to protect the ring of material from the heat and/or pressure. Without wishing to be bound by theory, it is believed that leaving this narrow area around the immediate rim of the aperture unmodified may enhance the elasticity of the wadding material around the periphery of the aperture.

Alternative means for modifying the wadding material may be envisaged by the skilled person, such as application of a chemical agent which imparts elasticity to the material, such as an elastomer (the precise nature of which is not particularly limited: non-limiting examples of the elastomer include natural rubber, neoprene rubber and spandex). However, the compression of the wadding material must be limited to ensure that the aperture can be made suitably elastic in the modified area so that, when the washer is fitted to upholstery together with a tuft (especially a tape tuft), the aperture may stretch sufficiently to accommodate a tufting needle or the like and then return to its original size state or at least an acceptable size state after the tufting needle is removed so as to prevent disengagement of the fitted tuft.

In order to provide some stability to all the fibres of the materials referred to above, the layers of materials or single wad of composite material may be 'needled'. This is a term known in the art of production of wadding as well as felt, where needles are used to make the fibres interlock with each other.

Preferably, the washers of the present invention are associated with one another. More preferably, the washers are connected in series in a chain. The chain can be fused across between each washer should it be necessary or beneficial.

FIGS. 8*a*, 8*b* and 9 illustrate a chain of washers 100*a*, 100*b*, 100*c*, 100*d* formed from the wadding material of FIG. 5. As can clearly be seen, the application of local pressure and heat in the region 102*a*, 102*b*, 102*c*, 102*d* around apertures 104*a*, 104*b*, 104*c*, 104*d* causes these regions to melt and compress. This makes it much more straightforward for the apertures to be formed such that their tops and bottoms are aligned, thereby allowing the washers to be conveniently fitted to a mattress using an automatic tufting machine.

Figure 10A:
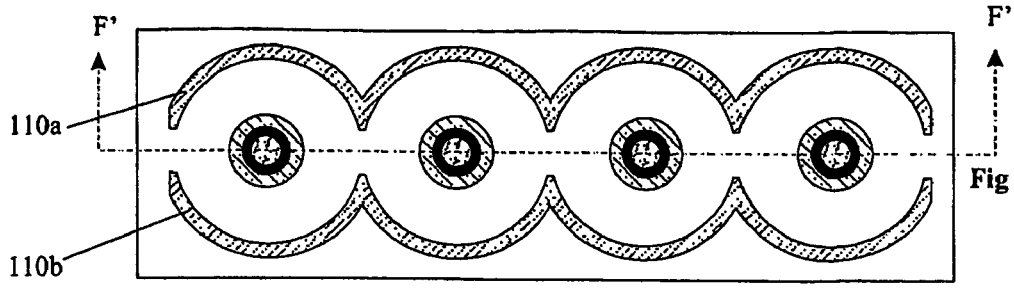
Figure 10B:
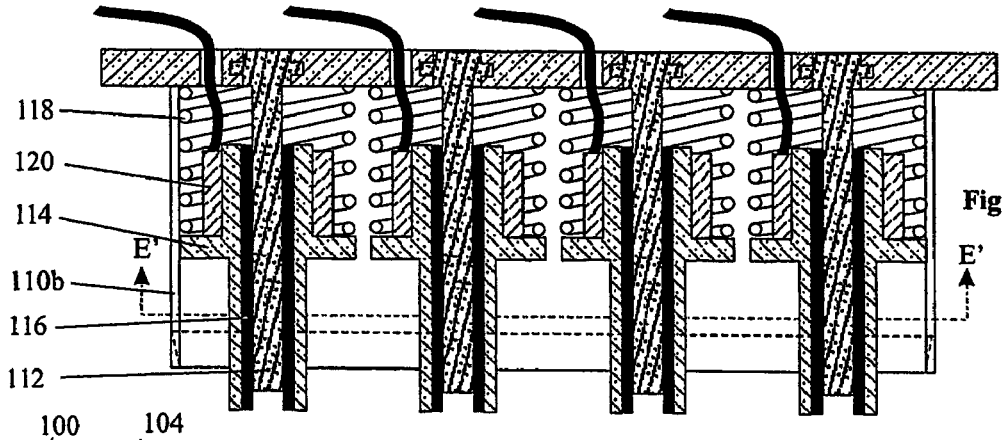
Figure 10C:
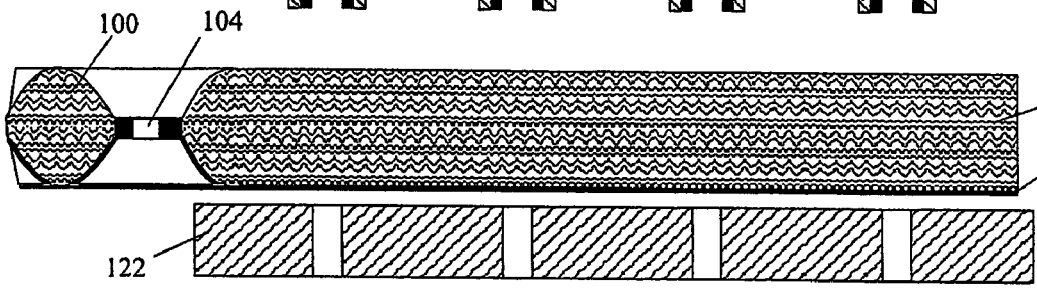

FIGS. 10*a*, 10*b* and 10*c* illustrate apparatus suitable for producing the washers of the present invention from wadding material 50 provided with transport material 52. The apparatus comprises a cutting form 110*a* and 110*b* which cuts against anvil 122, a punch 112 for providing aperture 104 through the wadding material, and a heated pressure rod 114 heatable by heating band 120 and shielded along the sides thereof by insulating and bearing sleeve 116. Spring 118 provides adequate pressure to fuse the wadding material whilst allowing sufficient pressure by the cutting form 110 to cut through the wadding.

The method of manufacture of the chain of washers is essentially a three part operation. Initially the apparatus descends, under the pressure of spring 118, sufficiently far enough for the heated elements 114 to compress and fuse the wadding in region 102 (including the region of intended aperture 104). The tool then continues to descend until the wadding is cut and punched to form aperture 104. The tool then rises clear of the wadding and the wadding is indexed on such that when the tool begins its next cycle, the end position of the previous cycle would join the next cycle, thus forming a continuous chain.

The washers according to the invention may be fitted, together with tape tufts, to a mattress using any means known in the art. Advantageously, the washers are fitted using an automatic tufting machine, for example, using the automatic tufting device and method described in GB-A-2363803. When the washers are linked in a continuous chain, a single washer may be cut from the chain prior to the needle and a tuft head passing through the central hole of the washers, as described in more detail in GB patent application nos. 0203495.7 and 0302824.8. The contents of these specifications are incorporated herein by reference thereto.

Figure 11:
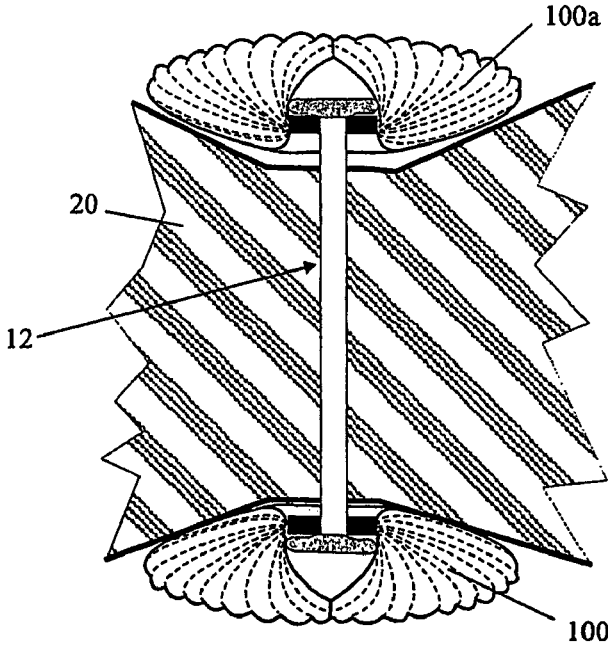
FIG. 11 is a sectional view of a mattress fitted with two washers according to the invention and a tape tuft.

FIG. 11 shows a section through a mattress 20 fitted with a tape tuft 12 and two washers 100*a*, 100*b* according to the invention. As is clearly evident, when the tape tuft 12 is under tension, the ends of the washer curl up to hide the head of the tape tuft 12. This enables the mattress fitted with the washers according to the invention to exhibit the perceived high quality appearance of, and be as comfortable to sit or lie on, as a mattress fitted with rosette or similar tufts, while allowing the mattress to be tufted more quickly and efficiently using an automatic tufting device.

Figure 12:
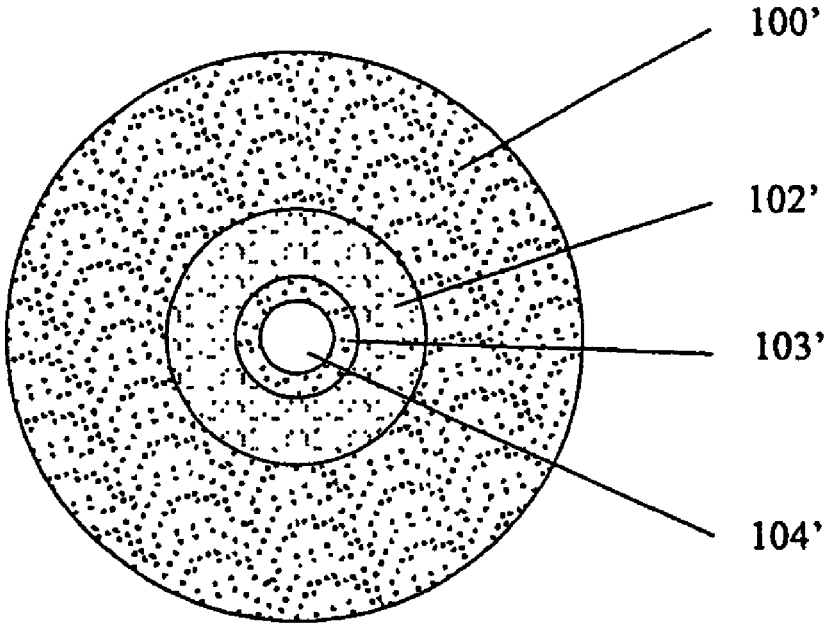
FIG. 12 is a top view of one form of washer of the present invention.

FIG. 12 illustrates a washer 100' according to an alternative embodiment of the invention. As can be seen, while the region 102' generally surrounding aperture 104' has been modified by fusion and compression, a narrow area 103' (typically about 1 mm in width) immediately surrounding aperture 104' remains uncompressed and unfused.

Figure 13:
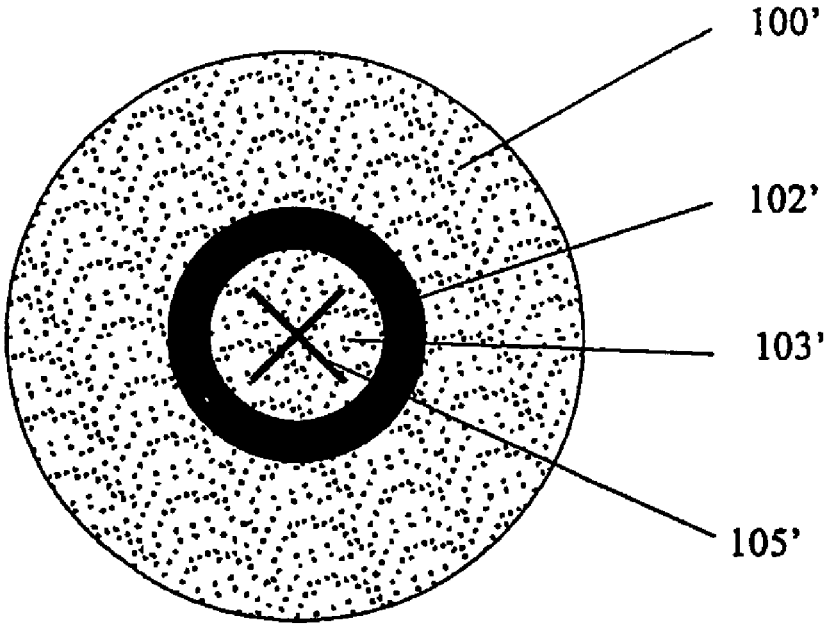
FIG. 13 is a top view of another form of washer of the present invention.

FIG. 13 illustrates a washer similar to that shown in FIG. 12, except that the aperture is provided by a cross-shaped cut 105'.

While the present application has been described hereinabove with reference to various preferred embodiments, the skilled reader will appreciate that modifications can be made without departing from the scope of the invention as defined in the claims.

The invention claimed is:

1. A washer comprising wadding material having an uncompressed portion, an aperture extending through the wadding material, and a permanently compressed portion at least around the periphery of the aperture to impart sufficient elasticity to the modified wadding material such that, when fitted to upholstery together with a tuft, the dimensions of the aperture may increase sufficiently to accommodate engagement means for the tuft and then return to a resting state after disengagement of the engagement means for the tuft so as to prevent disengagement of the tuft.

2. A washer according to claim 1, wherein the wadding material contains fusible material.

3. A washer according to claim 2, wherein the wadding material containing fusible material is compressed and/or fused at least around the periphery of the aperture.

4. A washer according to claim 1, associated with at least one further such washer.

5. A washer according to claim 4, connected in series to at least one further such washer.

6. A washer according to claim 1, wherein the aperture is provided by one or more cuts in the washer.

7. A washer according to claim 6, wherein the aperture is provided by two cuts in the form of a cross.

8. Upholstery fitted with at least one washer as defined in claim 1.

9. A washer according to claim 1, wherein an area immediately surrounding the aperture is uncompressed.

10. A washer comprising wadding material and having an aperture extending therethrough. characterized in that the wadding material is permanently compressed at least around the periphery of the aperture to impart sufficient elasticity to the modified wadding material such that, when fitted to upholstery together with a tuft, the dimensions of the aperture may increase sufficiently to accommodate engagement means for the tuft and then return to a resting state after disengagement of the engagement means for the tuft so as to prevent disengagement of the tuft, wherein an area immediately surrounding the aperture is uncompressed.

* * * * *